US010770823B1

(12) United States Patent
Li et al.

(10) Patent No.: US 10,770,823 B1
(45) Date of Patent: Sep. 8, 2020

(54) SAFETY SHIELD ASSEMBLY FOR POWER RECEPTACLE AND RELATED POWER RECEPTACLE

(71) Applicant: Chengli Li, Suzhou (CN)

(72) Inventors: Chengli Li, Suzhou (CN); Xiaoming Zhang, Suzhou (CN); Shengyun Nie, Suzhou (CN)

(73) Assignee: Chengli Li, Suzhou (CN)

( * ) Notice: Subject to any disclaimer, the term of this patent is extended or adjusted under 35 U.S.C. 154(b) by 0 days.

(21) Appl. No.: 16/446,107

(22) Filed: Jun. 19, 2019

(30) Foreign Application Priority Data

May 23, 2019 (CN) ..... 2019 1 0432262
May 23, 2019 (CN) ..... 2019 2 0746032 U

(51) Int. Cl.
*H01R 13/44* (2006.01)
*H01R 13/453* (2006.01)
*H01R 25/00* (2006.01)

(52) U.S. Cl.
CPC ..... *H01R 13/4536* (2013.01); *H01R 13/4534* (2013.01); *H01R 25/006* (2013.01)

(58) Field of Classification Search
CPC ..... H01R 13/447; H01R 13/453; H01R 13/4534; H01R 13/4536; H01R 25/006
USPC ..... 439/135–139
See application file for complete search history.

(56) References Cited

U.S. PATENT DOCUMENTS

| | | | | |
|---|---|---|---|---|
| 6,767,229 | B1 * | 7/2004 | Wang | H01R 13/4532 439/145 |
| 7,312,963 | B1 * | 12/2007 | Radosavljevic | H01R 13/4534 361/115 |
| 8,187,012 | B1 * | 5/2012 | Baldwin | H01R 13/4534 439/137 |
| 2016/0013577 | A1 * | 1/2016 | Diakomis | H01R 13/4536 439/138 |
| 2016/0301154 | A1 * | 10/2016 | Lee | H01R 13/4534 |

* cited by examiner

*Primary Examiner* — Khiem M Nguyen
(74) *Attorney, Agent, or Firm* — Chen Yoshimura LLP

(57) ABSTRACT

A safety shield assembly for a power receptacle and a power receptacle incorporating the same. The safety shield assembly includes a frame and a sliding block and a resilient member disposed in the frame. The frame has multiple openings corresponding to multiple socket holes of the power receptacle, a position limiting member configured to abut the sliding block, and a balancing support member. In its initial state, the resilient member urges the sliding block to a closed position to covers the openings. The sliding block has two inclined surfaces. When an inserted object pushes on only one of the two inclined surfaces, the position limiting member limits the sliding motion of the sliding block; when two inserted objects simultaneously push on both inclined surfaces, the sliding block is balanced on the balancing support member and is able to slides along the frame to expose the openings.

19 Claims, 10 Drawing Sheets

SAFETY SHIELD ASSEMBLY FOR POWER RECEPTACLE AND RELATED POWER RECEPTACLE

BACKGROUND OF THE INVENTION

Field of the Invention

This invention generally relates to home appliances, and in particular, it relates to a safety shield assembly for a power receptacle and a power receptacle having such a safety shield assembly.

Description of Related Art

Power receptacles are widely used in homes and public places. Conventional power receptacles often have exposed socket holes. If a metal piece or other conductive object is inserted into the socket holes, such as by a child or even by an adult due to inadvertent operation, electrical shocks may result, causing personal harm or property damage. Some current power receptables have safety shields, but they often have complex structures and are difficult to assemble. Thus, they are often unsuitable for automated production and assembly, resulting in high cost and low production efficiency. Thus, there is a need for power receptacles with safety shields that have a simple structure and can lower cost and increase production sufficiency.

SUMMARY

To solve the above problems, embodiments of the present invention provide a safety shield assembly for a power receptacle, which can move when a power plug is inserted, and can prevent objects other than power plugs from being inserted, or prevent a power plug from being incorrectly inserted. It improves safety of the power receptacle, prevents electric shocks, and at the same time has the advantage of low cost and convenient automatic assembling.

In one aspect, the present invention provides a safety shield assembly for a power receptacle, which includes: a frame; a sliding block disposed in the frame; and a resilient member disposed in the frame; wherein the frame includes a bottom panel with at least two openings corresponding to at least two socket holes of the power receptacle, a position limiting member configured to abut the sliding block, and a balancing support member, wherein when the resilient member is in its initial state, it urges the sliding block to a closed position where the sliding block covers the at least two openings, wherein the sliding block further includes two inclined surfaces, wherein when an inserted object pushes on only one of the two inclined surfaces, the position limiting member limits a sliding motion of the sliding block, and wherein when two inserted objects simultaneously push on the two inclined surfaces, the sliding block is balanced on the balancing support member and slides along the frame to expose the at least two openings.

Specific embodiments of the present invention include the following.

In some embodiments, the balancing support member includes an elongated bump having a curved surface that protrudes from an inner bottom surface of the frame, wherein the bump is elongated in a direction perpendicular to a sliding direction of the sliding block, and wherein when the resilient member is in its initial state, the balancing support member is located near a center of a bottom surface of the sliding block.

In some embodiments, the balancing support member includes a pair of bumps disposed symmetrically on the bottom surface of the frame and spaced apart from each other in the direction perpendicular to the sliding direction of the sliding block.

In some embodiments, the sliding block further includes a groove to accommodate one end of the resilient member, wherein the groove includes a working surface configured to drive deformation of the resilient member, and a locking surface configured to keep the resilient member in a deformed state.

In some embodiments, the frame further includes a retaining member configured to retain the resilient member, the retaining member including either a protruding shaft that protrudes from the inner bottom surface or an inner side surface of the frame, or a receding slot on the inner bottom surface or the inner side surface of the frame.

In some embodiments, the position limiting member includes a protruding block that protrudes from an inner bottom surface of the frame, and wherein the sliding block includes a first position limiting face configured to abut the protruding block.

In some embodiments, the protruding block is disposed near at least one of the at least two openings of the frame.

In some embodiments, the sliding block includes a second position limiting face configured to abut a second position limiting protrusion on the power receptacle.

In some embodiments, the second position limiting protrusion is disposed near at least one of the at least two socket holes of the power receptacle.

In some embodiments, the two inclined surfaces have different sizes.

In some embodiments, the resilient member includes a pressure spring, a tension spring, a resilient plate, or a torsion spring.

In another aspect, the present invention provides a power receptacle, which includes at least one safety shield assembly described above; a body, including an upper cover and a base connected together; and at least two plug receiving plates disposed in the body, wherein the safety shield assembly is disposed between the upper cover and the at least two plug receiving plates.

In some embodiments, the power receptable further includes a leakage current protection assembly.

In some embodiments, the upper power receptacle complies with ANSI/NEMA WD6 standard.

The safety shield assembly provided by embodiments of the present invention has a simple structure, is safe and reliable, convenient to use, and can be compatible with various types of power receptacles. Because of the simple structure, the device can be easily assembled in large scale production with high efficiency. The device is low cost and has wide applications.

BRIEF DESCRIPTION OF THE DRAWINGS

Preferred embodiments of the present invention are described with reference to the drawings. In these drawings, like reference symbols represent like features.

DETAILED DESCRIPTION OF PREFERRED EMBODIMENTS

A power receptacle according to preferred embodiments of the present is described below. It should be understood that these descriptions describe embodiments of the present invention but do not limit the scope of the invention. When describing the various components, directional terms such as "up," "down," "top," "bottom" etc. are not absolute but are relative. These terms may correspond to the views in the various illustrations, and can change when the views or the relative positions of the components change.

Figure 1B:
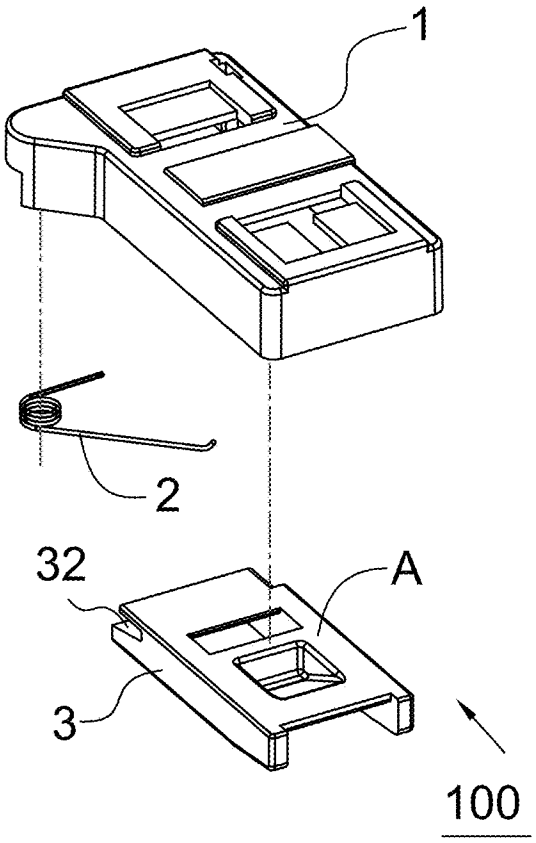
FIG. 1B is another exploded view of the safety shield assembly of FIG. 1A from another viewing angle.
Figure 1A:
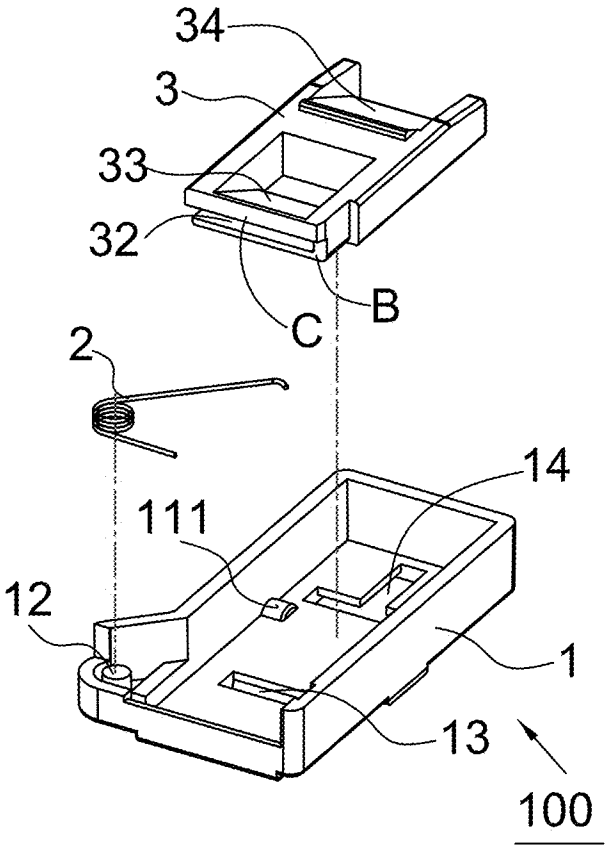
FIG. 1A is an exploded view of a safety shield assembly for a power receptacle according to an embodiment of the present invention.
Figure 1C:
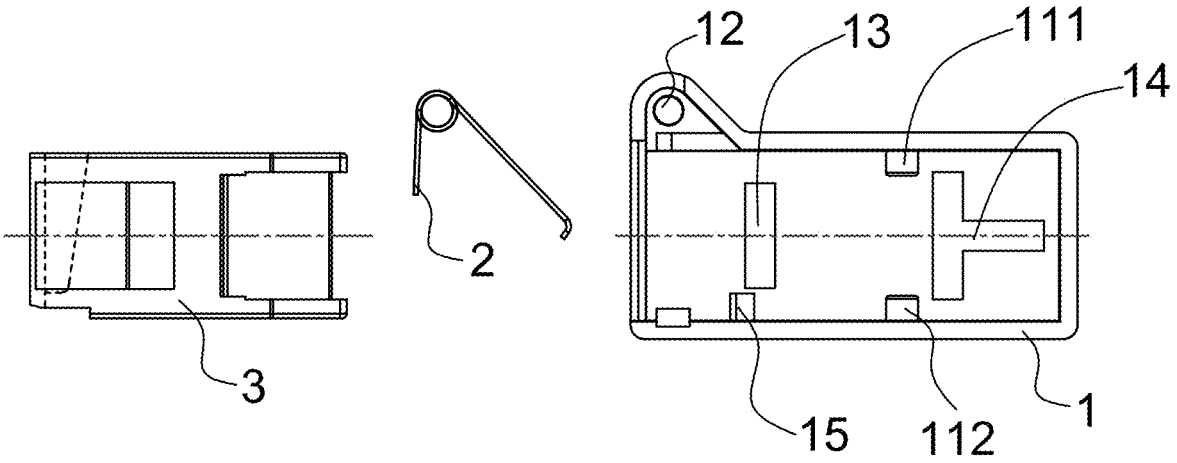
FIG. 1C is another exploded view of the safety shield assembly of FIG. 1A from yet another viewing angle.

Refer to FIGS. 1A to 1C, which illustrate a safety shield assembly 100 for a power receptacle according to an embodiment of the present invention. The safety shield assembly 100 includes a frame 1, and a sliding block 3 and resilient member 2 disposed within the frame 1. The frame 1 has a bottom panel and a side wall, and is preferably open at the top. The bottom panel is configured to have multiple openings corresponding to the shape of the socket holes of the receptacle, such as I shaped openings or T shaped openings. For example, FIG. 1A illustrates an I shaped opening 13 and a T shaped opening 14, which are suitable for various standard power receptacles. The frame 1 is further configured to have a position limiting member and a balancing support member that can abut the sliding block 3. The sliding block 3 has two inclined surfaces 33 and 34 facing upwards. When an object is attempted to be inserted but is only pushing on one of the two inclined surfaces 33 and 34, due to the effect of the balancing support member, the sliding block becomes tilted and the position limiting member prevents the sliding block 3 from sliding. When an object is attempted to be inserted by pushing simultaneously on both inclined surfaces, due to the effect of the balancing support member, the sliding block 3 remains untilted and is able to slide along the frame 1 to expose the socket holes. In this connection, note that an opening is provided near the lower end of the inclined surface 33 to allow the prong to pass through, and the sliding block 3 ends at the lower end of the inclined surface 34 which allows the other prong to pass through. Preferably, the resilient member 2 is configured such that it urges the sliding block 3 toward a closed position where the sliding block 3 covers the socket holes. This way, the safety shield assembly can effectively prevent an object from being inserted or prevent the plug prongs from being incorrectly inserted. Moreover, in the protecting state (i.e., when the sliding block covers the socket holes), the safety shield assembly can isolate components inside the power receptacle from the environment, thereby protecting them from undesirable environmental factors (such as dust, moisture, etc.).

Figure 3A:
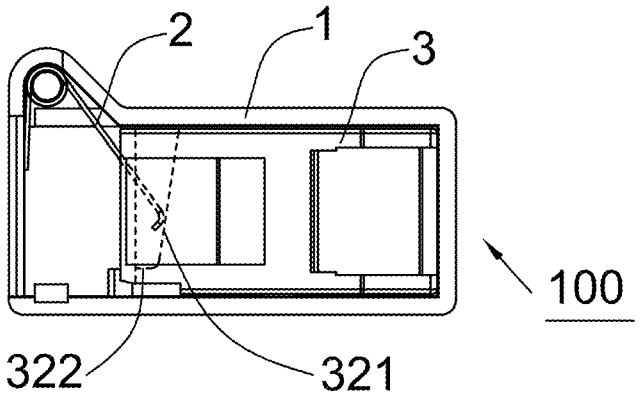
FIG. 3A is a plan view of the safety shield assembly in a closed state.
Figure 3B:
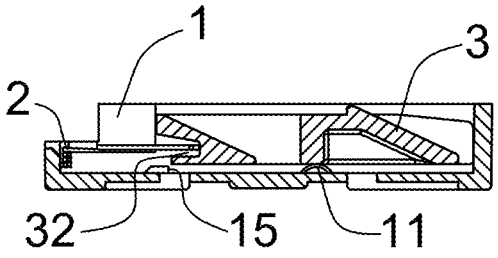
FIG. 3B is a cross-sectional view of the safety shield assembly shown in FIG. 3A.
Figure 4A:
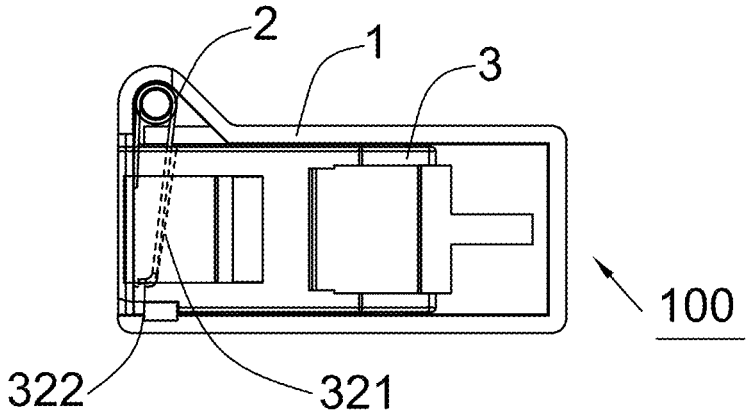
FIG. 4A is a plan view of the safety shield assembly in an open state.
Figure 4B:
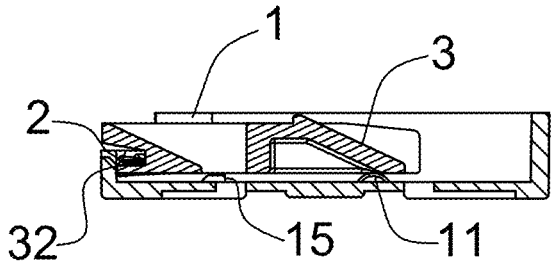
FIG. 4B is a cross-sectional view of the safety shield assembly shown in FIG. 4A.

In some embodiments, the balancing support member is an elongated bump 11 having a curved surface that protrudes from the inner bottom surface of the frame 1 (see FIGS. 3B and 4B). The bump 11 is elongated in the direction perpendicular to the sliding direction of the sliding block 3. Preferably, the balancing support member is located between the two openings of the frame, and when the sliding block 3 is in the closed position, the balancing support member is located approximately at the center of the bottom surface of the sliding block 3. Thus, the bump 11 can balance the sliding block 3 on it and allow the sliding block to pivot with respect to the frame as well as to slide along the frame. It can also reduce friction, thereby prolonging product life. It should be understood that the bump 11 may also be configured as a ridge, or a series of protruding dots that are spaced apart in the direction perpendicular to the sliding direction of the sliding block, or even a single relatively large protruding dot.

In the illustrate embodiment (see FIGS. 1A and 1C), the balancing support member includes a pair of bumps 111, 112 disposed symmetrically on the bottom surface of the frame 1 and spaced apart from each other in the direction perpendicular to the sliding direction of the sliding block.

Figure 2:
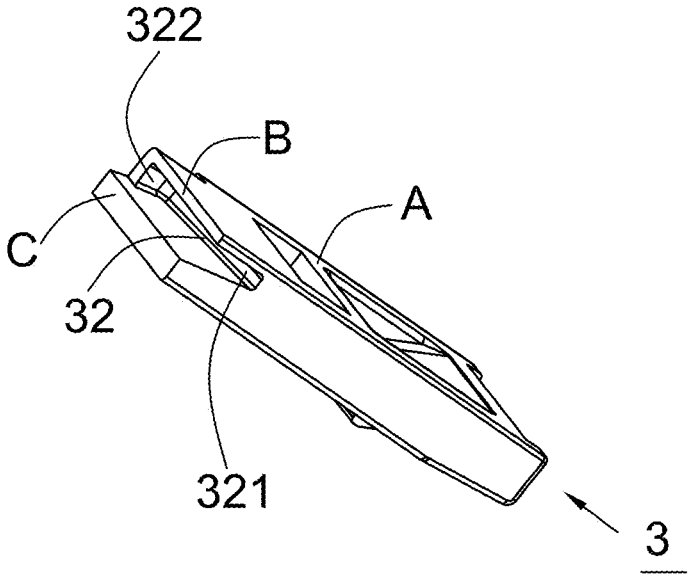
FIG. 2 illustrates a sliding block of the safety shield assembly of FIGS. 1A-1C.

As shown in FIG. 1C, the position limiting member of the frame 1 includes a protruding block 15 that protrudes from the inner bottom surface of the frame 1. The protruding block may be a protruding cube, ridge or dot. Advantageously, the protruding block 15 is disposed near at least one of the openings in the bottom of the frame. Alternatively, the protruding block 15 may protrude from the side wall of the frame 1. As shown in FIG. 2, the sliding block 3 has a bottom surface A that faces, and is approximately parallel to, the inner bottom surface of the frame 1. The sliding block 3 has a first position limiting face B that is configured to abut the protruding block 15 under some conditions as described later. To achieve the goal of limiting the position of the sliding block 3, the power receptacle is provided with a second position limiting protrusion 41, as shown in FIGS. 5B to 7B. Note that the second position limiting protrusion 41 may alternatively be provided on the frame 1 itself, such as a sideways protrusion from the sidewall of the frame 1. Advantageously, the second position limiting protrusion 41 is disposed near at least one of the openings. Correspondingly, the sliding block 3 has a second position limiting face C that is configured to abut the second position limiting protrusion 41 under some conditions, as described later.

Referring to FIGS. 1A to 4B, the resilient member 2 may be any of a pressure spring, tension spring, resilient plate, torsion spring, etc. A torsion spring is shown in the figures as an example. One end of the resilient member 2 abuts the sliding block 3, and the other end of it abuts a corresponding structure of the frame 1, such as the inner side surface of the frame 1. The frame 1 also has a retaining member for retaining the resilient member 2, such as a protruding shaft that protrudes from the inner bottom surface or the inner side surface of the frame, or a receding slot on the inner bottom surface or the inner side surface of the frame. In the example of FIGS. 1A and 1C, a shaft 12 that protrudes from the inner bottom surface of the frame 1 serves as the retaining member. To simplify the structure and reduce the space occupied in the power receptacle, the sliding block 3 is provided with a groove 32 to accommodate one end of the resilient member 2. The groove 32 also facilitates the positioning and assembling of the sliding block and the resilient member. In some embodiment, the groove 32 has a working surface 321 that drives the deformation of the resilient member 2, and a locking surface 322 that keeps the resilient member 2 in the deformed state. More specifically, referring to FIGS. 3A and 3B, when the resilient member 2 is in its initial state, i.e., when the sliding block 3 covers the openings in the frame (and hence the socket holes of the power receptacle), if the prongs of a plug is normally inserted, the end of the resilient member 2 that abuts the sliding block 3 becomes deformed as the sliding block 3 slides, and its position moves along the working surface 321 until it reaches the locking surface 322. At this time, the openings (and hence the socket holes) become exposed, so the prongs can be successfully inserted, as shown in FIGS. 4A and 4B.

As can be seen from the drawings, in some embodiments, the two inclined surfaces of the sliding block may be designed to have sizes (but the same inclination angle), so the two inserted prongs have different amount of travel along the inclined surfaces. For example, the inclined surface 33 is sized to suit the I shaped opening 13, while the inclined surface 34 has a larger size to suit the T shaped opening 14. This allows the safety shield assembly to be used with power receptacles of different standard models, such as ANSI/NEMA WD6 standard models.

The operation of the safety shield assembly is described below with reference to FIGS. 5A to 7B.

The power receptacle is shown to include a body and plug receiving plates 51 and 52 disposed in the body. The body includes an upper cover 4 and a base 6 connected together. The safety shield assembly is disposed between the upper cover 4 and the plug receiving plates 51 and 52.

When no object is being inserted into the power receptacle, in the safety shield assembly, due to the action of the resilient member 2, the sliding block 3 is maintained in a motionless condition and does not tilt relative to the frame, and the safety shield assembly is in a closed state.

Figure 5B:
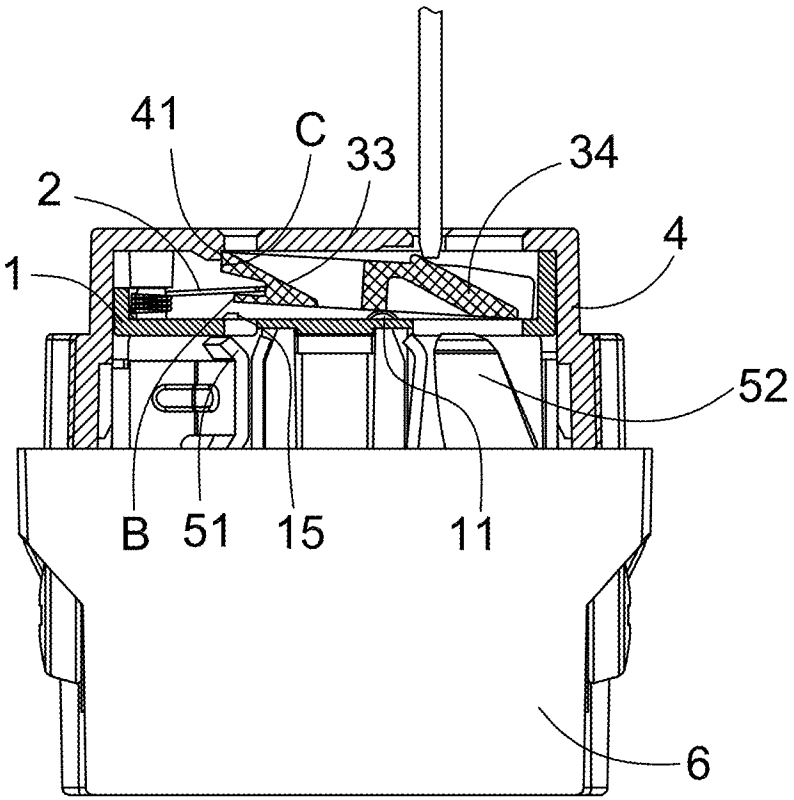
FIG. 5B is another cross-sectional view of the power receptacle equipped with the safety shield assembly in the protecting state, showing a foreign object being inserted in another one of the socket holes.
Figure 5A:
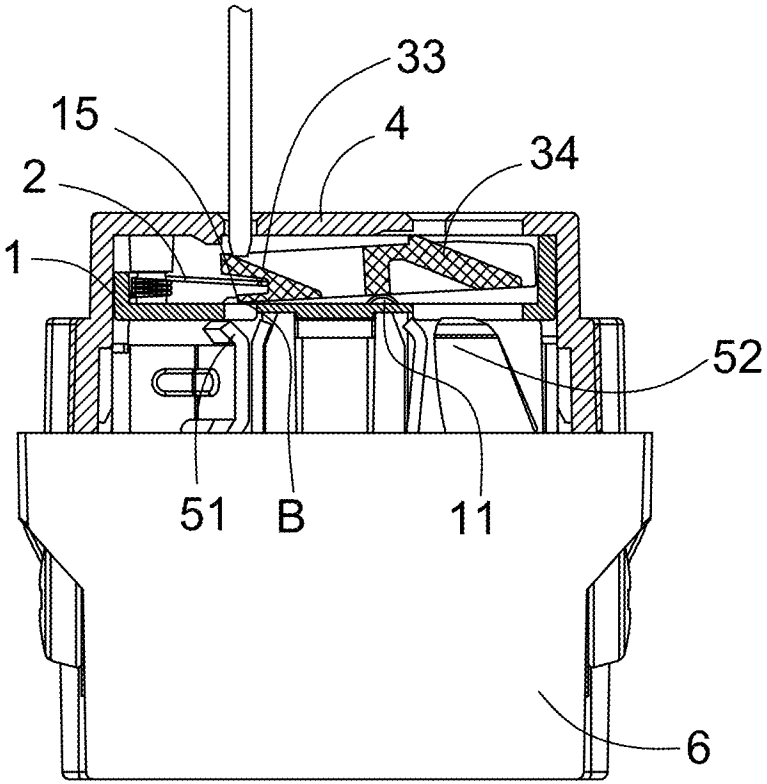
FIG. 5A is a cross-sectional view of a power receptacle equipped with the safety shield assembly in a protecting state, showing a foreign object being inserted in only one of the socket holes.
Figure 6B:
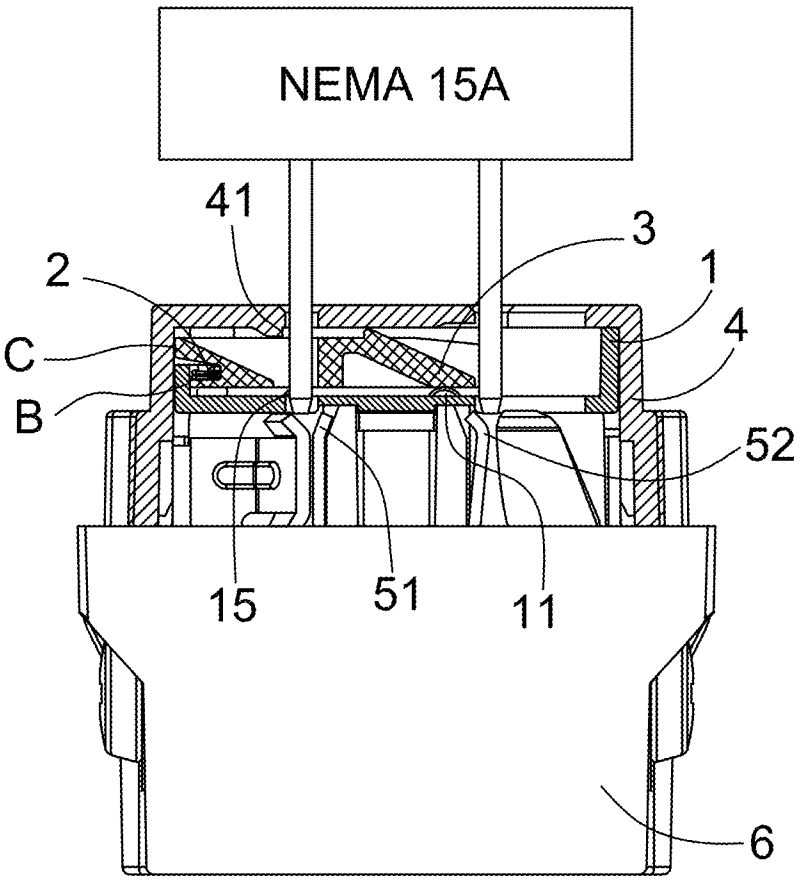
FIG. 6B is a cross-sectional view of the power receptacle equipped with the safety shield assembly in the normal working state, where the prongs of the NEMA 15A plug are normally inserted into the power receptacle.
Figure 6A:
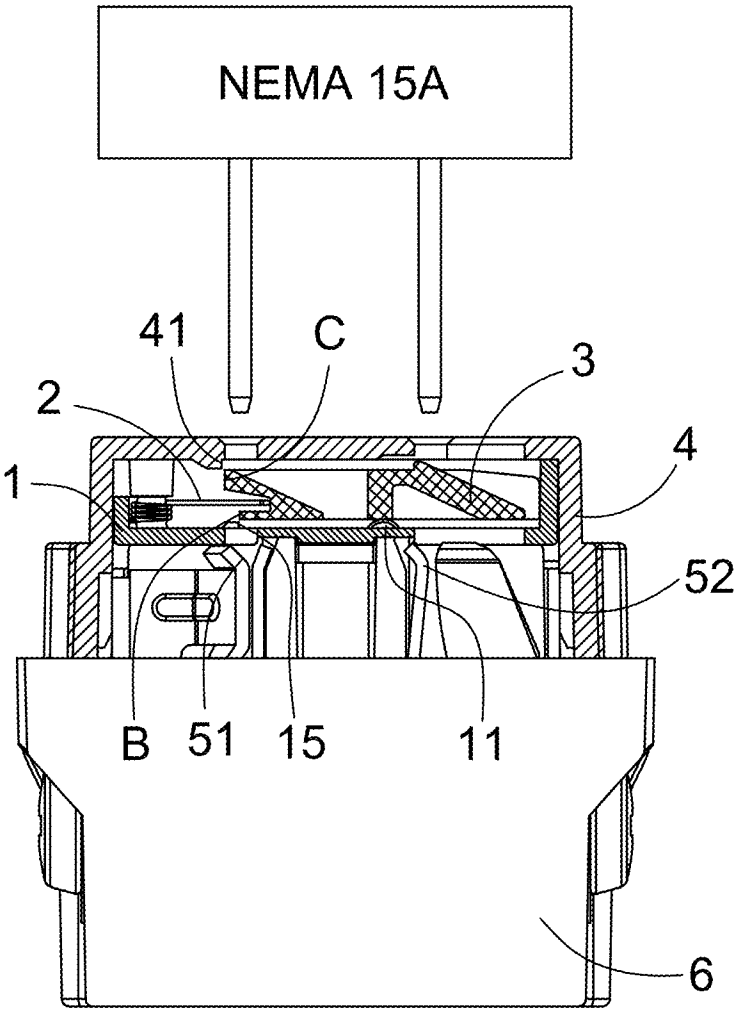
FIG. 6A is a cross-sectional view of the power receptacle equipped with the safety shield assembly in a normal working state, where the prongs of an NEMA 15A plug are ready to be inserted into the power receptacle.

When an object is attempted to be inserted into only one of the socket holes of the power receptacle, for example into the hole on the left hand side as shown in FIG. 5A, the object contacts the inclined surface 33 of the sliding block 3 and exerts a downward force on the inclined surface 33. Due to the presence of the bump 11, the right hand side of the sliding block 3 will be tilted upwards and the left hand side is tilted downwards, and the first position limiting face B on the left hand side of the sliding block 3 will be pushed against the protruding block 15 of the frame 1. This limits the sliding motion of the sliding block 3, so as to prevent the object from being further inserted. Similarly, when an object is attempted to be inserted into only the socket hole on the right hand side as shown in FIG. 5B, the object exerts a downward force on the inclined surface 34 of the sliding block 3. Thus, the left hand side of the sliding block 3 will be tilted upwards, and the second position limiting face C of the sliding block 3 will be pushed against the second position limiting protrusion 41 on the body of the power receptacle. This again limits the sliding motion of the sliding block 3, so as to prevent the object from being further inserted. This way, the safety shield assembly protects against insertion by an object into a single hole of the power receptacle.

Figure 7B:
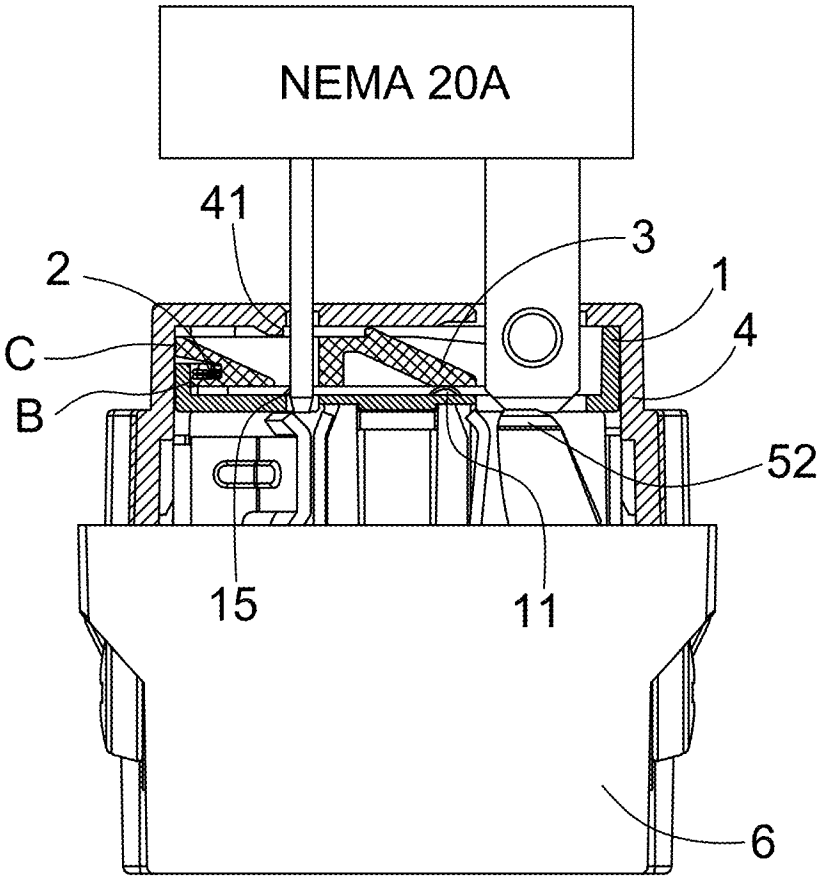
FIG. 7B is a cross-sectional view of the power receptacle equipped with the safety shield assembly in the normal working state, where the prongs of the NEMA 20A plug are normally inserted into the power receptacle.
Figure 7A:
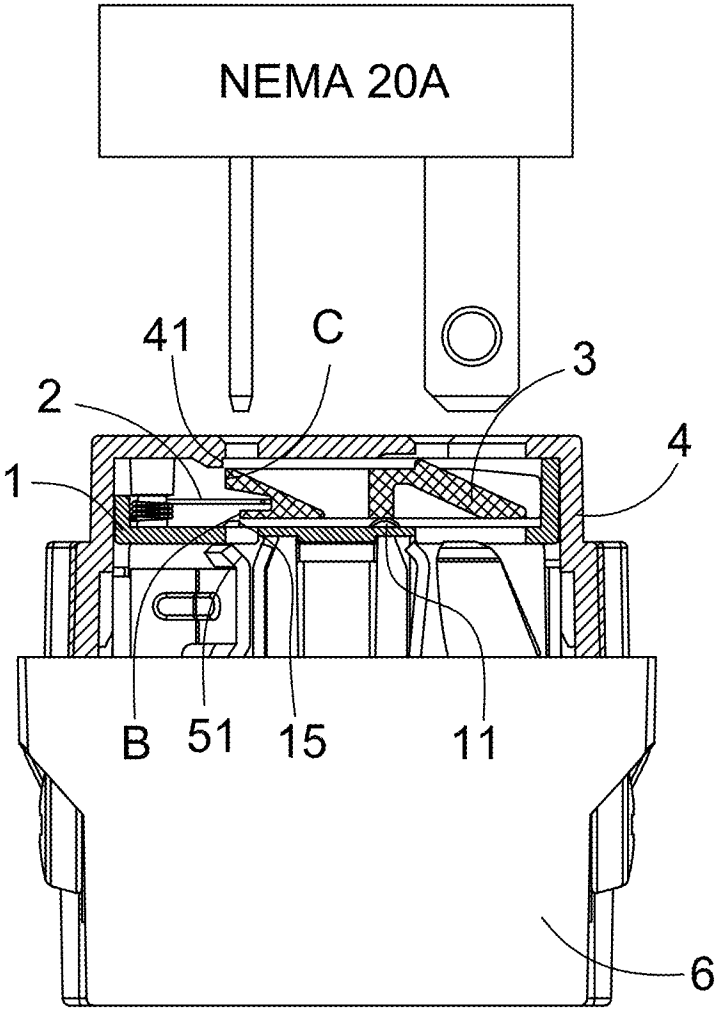
FIG. 7A is a cross-sectional view of the power receptacle equipped with the safety shield assembly in a normal working state, where the prongs of an NEMA 20A plug are ready to be inserted into the power receptacle.

As mentioned earlier, the safety shield assembly according to embodiments of the present invention is suitable for various power receptacles complying with the ANSI/NEMA WD6 standard, such as 1-15P, 5-15P, 5-20P, 6-15P, 6-20P, etc. When a plug complying with the standard, for example, an NEMA 15A plug shown in FIGS. 6A and 6B, or an NEMA 20A plug shown in FIGS. 7A and 7B, is attempted to be inserted, with the two prongs of the plug simultaneously inserted into the two holes of the upper cover 4, due to the balancing effect of the bump 11, the sliding block 3 will not tilt with respect to the frame 1. Thus, the downward force exerted on the two inclined surfaces of the sliding block 3 causes the sliding block 3 to slide along the frame 1 against the spring force of the resilient member 2, thereby exposing the socket holes to allow the prongs to be properly inserted. The prongs contact the plug receiving plates 51 and 52 to establish electrical connection. It should be noted that when the plug is removed from the power receptacle, due to the spring force of the resilient member 2, the sliding block 3 will slide back to its closed position and will continue to perform the protection function.

Figure 8A:
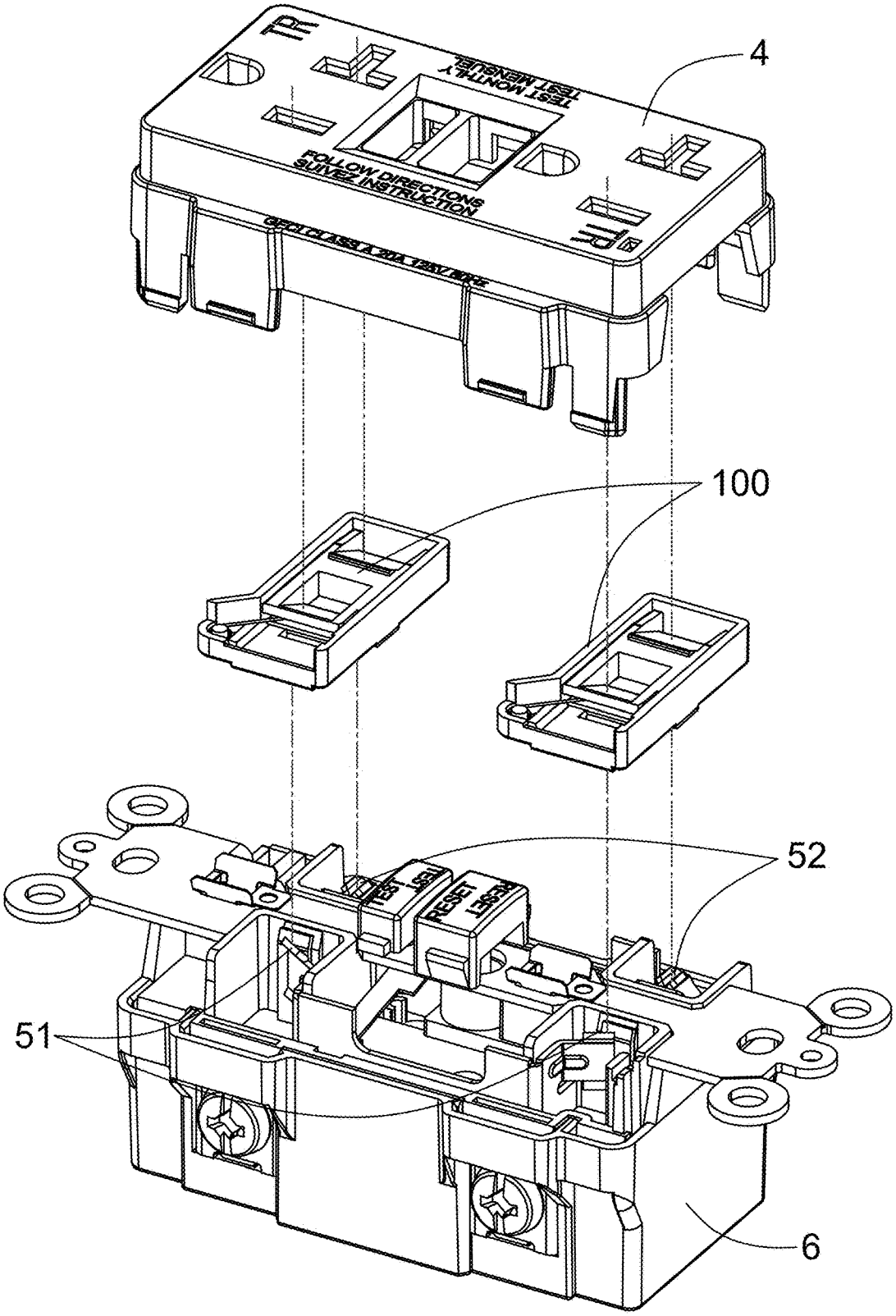
FIG. 8A is an exploded view of a power receptacle incorporating a safety shield assembly according to an embodiment of the present invention.
Figure 8B:
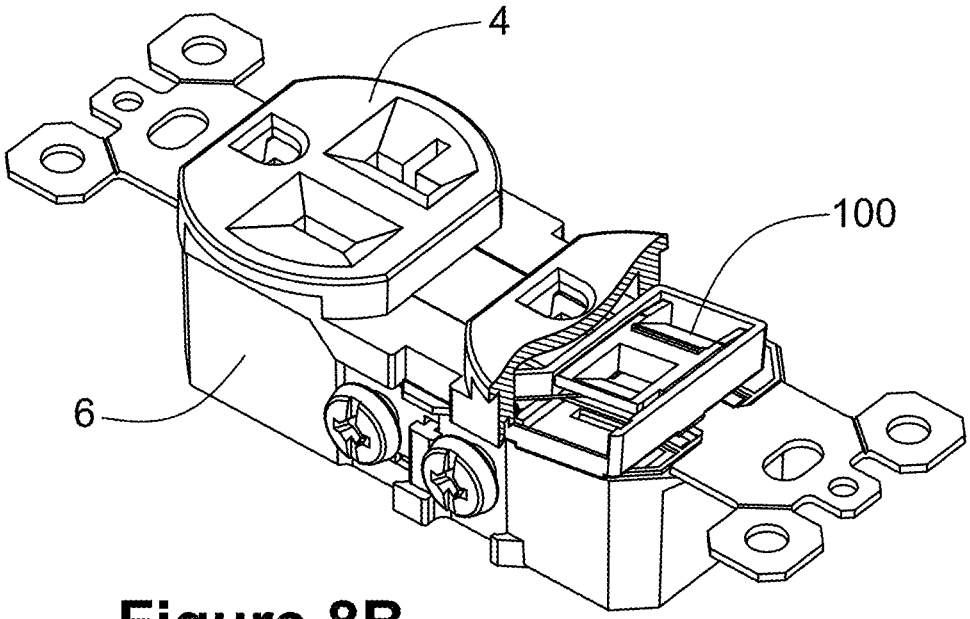
FIG. 8B is a partial cut-away view of a power receptacle incorporating a safety shield assembly according to another embodiment of the present invention.
Figure 8C:
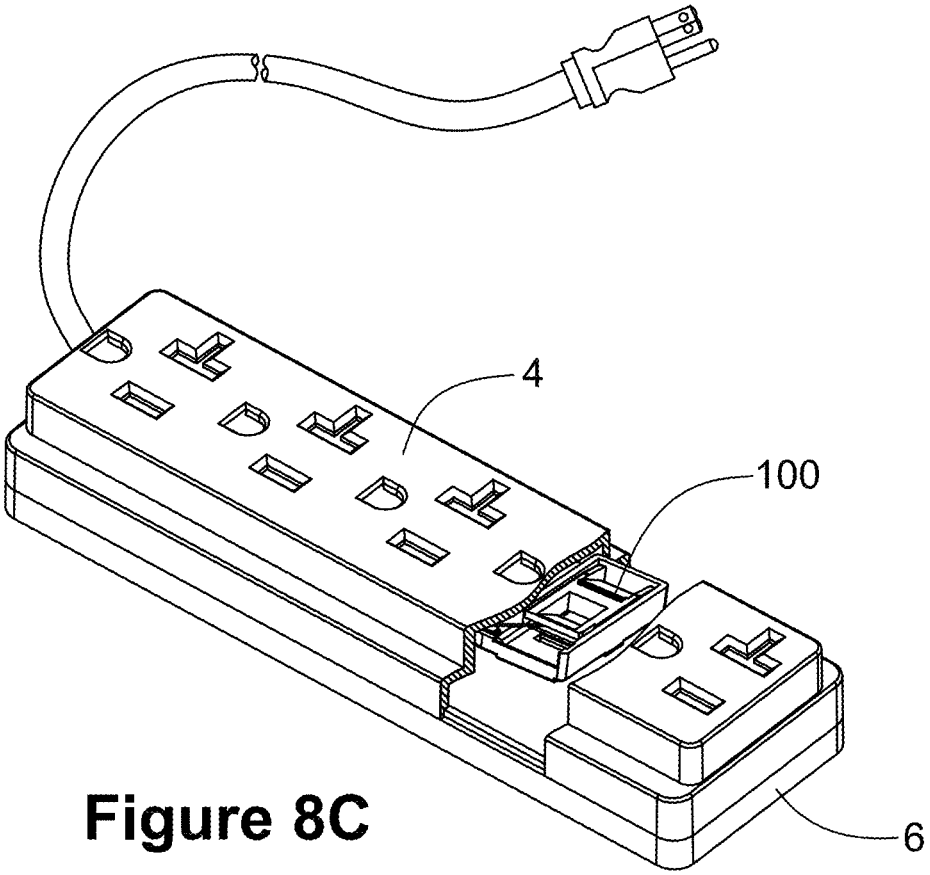
FIG. 8C is a partial cut-away view of a power receptacle incorporating a safety shield assembly according to yet another embodiment of the present invention.
Figure 9:
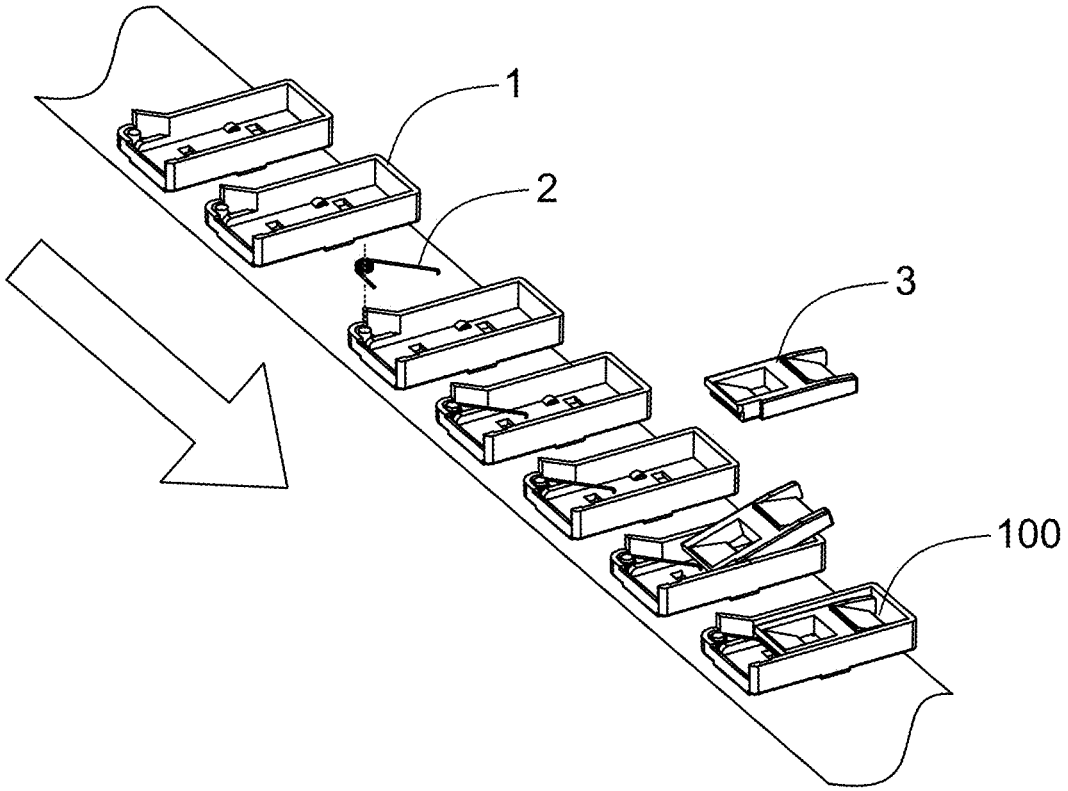
FIG. 9 illustrates an automatic assembling process for the safety shield assembly according to an embodiment of the present invention.

FIGS. 8A to 8C illustrate the structures of a number of power receptacles that incorporate the safety shield assembly according to embodiments of the present invention. The power receptacle shown in FIG. 8A is similar to those shown in FIGS. 6A-7B, and includes two safety shield assemblies 100. As seen in FIGS. 8B and 8C, the shape of the holes for the positive and negative lines and ground line may be modified based on practical need, and the power receptacle may be either a wall mounted receptacle or a power strip, but the structure of the safety shield assembly 100 does not need to be changed. Further, because the safety shield assembly has a compact and simple structure, the overall size of the power receptacle does not significantly increase when the safety shield assembly is incorporated. Thus, the safety shield assembly can have wide applicability. Moreover, because the safety shield assembly has relatively few components, and the various components can limit the position of each other, the assembling process is easy to automate. For example, FIG. 9 illustrates an automated assembling process for the safety shield assembly. The arrows in the figure show the assembling steps, which sequentially include providing the frame 1, resilient member 2 and sliding block 3, and automatically assembling them together while the parts are on the assembly line. First, the resilient member 2 is installed in the frame 1 and fixed therein. The sliding block 3 is then placed into the frame 1, and the resilient member 2 is fitted into the slot of the sliding block 3. This accomplishes the assembling of the safety shield assembly in a fast and convenient manner. In some embodiments, the various components of the safety shield assembly may be automatically assembled. In some embodiments, multiple safety shield assembly can be automatically assembled simultaneously.

The power receptacle may include a leakage current protection assembly, which may be any suitable leakage current protection assembly known in the art.

It should be appreciated that the embodiments in FIGS. 1A to 9 only show some possible shapes, sizes and spatial arrangements of the components of the safety shield assembly and power receptacle of the present invention. These illustrations are not limiting. Other shapes, sizes and spatial arrangements may be used without departing from the spirit of the present invention. Further, the frame and sliding block of the above described safety shield assembly are respectively shown as integral pieces, which is convenient for processing and assembly; however, they may also be separate pieces or partly integrated and partly separate, depending on the number of the socket holes.

It will be apparent to those skilled in the art that various modification and variations can be made in the safety shield assembly and power receptacle and related assembling method of the present invention without departing from the spirit or scope of the invention. Thus, it is intended that the present invention cover modifications and variations that come within the scope of the appended claims and their equivalents.

What is claimed is:

1. A safety shield assembly for a power receptacle, comprising:

a frame;

a sliding block disposed in the frame; and a resilient member disposed in the frame;

wherein the frame includes a bottom panel with at least two openings corresponding to at least two socket holes of the power receptacle, a position limiting member configured to abut the sliding block, and a balancing support member, wherein when the resilient member is in its initial state, it urges the sliding block to a closed position where the sliding block covers the at least two openings, wherein the sliding block further includes two inclined surfaces, wherein when an inserted object pushes on only one of the two inclined surfaces, the position limiting member limits a sliding motion of the sliding block, and wherein when two inserted objects simultaneously push on the two inclined surfaces, the sliding block is balanced on the balancing support member and slides along the frame to expose the at least two openings.

2. The safety shield assembly of claim 1, wherein the balancing support member includes an elongated bump having a curved surface that protrudes from an inner bottom surface of the frame, wherein the bump is elongated in a direction perpendicular to a sliding direction of the sliding block, and wherein when the resilient member is in its initial state, the balancing support member is located near a center of a bottom surface of the sliding block.

3. The safety shield assembly of claim 2, wherein the balancing support member includes a pair of bumps disposed symmetrically on the bottom surface of the frame and spaced apart from each other in the direction perpendicular to the sliding direction of the sliding block.

4. The safety shield assembly of claim 1, wherein the sliding block further includes a groove to accommodate one end of the resilient member, wherein the groove includes a working surface configured to drive deformation of the resilient member, and a locking surface configured to keep the resilient member in a deformed state.

5. The safety shield assembly of claim 1, wherein the frame further includes a retaining member configured to retain the resilient member, the retaining member including either a protruding shaft that protrudes from the inner bottom surface or an inner side surface of the frame, or a receding slot on the inner bottom surface or the inner side surface of the frame.

6. The safety shield assembly of claim 1, wherein the position limiting member includes a protruding block that protrudes from an inner bottom surface of the frame, and wherein the sliding block includes a first position limiting face configured to abut the protruding block.

7. The safety shield assembly of claim 6, wherein the protruding block is disposed near at least one of the at least two openings of the frame.

8. The safety shield assembly of claim 6, wherein the sliding block includes a second position limiting face configured to abut a second position limiting protrusion on the power receptacle.

9. The safety shield assembly of claim 8, wherein the second position limiting protrusion is disposed near at least one of the at least two socket holes of the power receptacle.

10. The safety shield assembly of claim 1, wherein the two inclined surfaces have different sizes.

11. The safety shield assembly of claim 1, wherein the resilient member includes a pressure spring, a tension spring, a resilient plate, or a torsion spring.

12. A power receptacle, comprising:

at least one safety shield assembly of claim 1;

a body, including an upper cover and a base connected together; and at least two plug receiving plates disposed in the body, wherein the safety shield assembly is disposed between the upper cover and the at least two plug receiving plates.

13. The power receptacle of claim 12, further including a leakage current protection assembly.

14. The power receptacle of claim 12, wherein the upper power receptacle complies with ANSI/NEMA WD6 standard.

15. A safety shield assembly for a power receptacle, comprising:

a frame, having a bottom panel configured to define at least two openings;

a sliding block disposed in the frame; and a resilient member disposed in the frame;

wherein the resilient member is configured to urge the sliding block toward a closed position, wherein when in the closed position, the sliding block covers the at least two openings of the frame, wherein the frame further includes a balancing support member located between the at least two openings and configured to pivotally support the sliding block, wherein the sliding block includes two inclined surfaces facing upwards, which are located at positions corresponding to the at least two openings of the frame when the sliding block is at the closed position, wherein the sliding block is configured to change from a first pivoting state to a second pivoting state in response to an external force exerted on only one of the two inclined surfaces, and to remain in the first pivoting state in response to forces simultaneously exerted on both of the two inclined surfaces, and wherein the frame further includes a position limiting member configured to restrict a sliding motion of the sliding block when the sliding block is at the closed position and in the second pivoting state, and to not restrict the sliding motion of the sliding block when the sliding block is in the first pivoting state.

16. The safety shield assembly of claim 1, wherein the balancing support member is a protrusion from an inner surface of the bottom panel of the frame.

17. The safety shield assembly of claim 1, wherein the position limiting member is a protrusion from an inner surface of the bottom panel of the frame or from a inner side surface of the frame.

18. A power receptacle, comprising:

at least one safety shield assembly of claim 15;

a body, including an upper cover and a base connected together, the upper cover including at least two socket holes; and at least two plug receiving plates disposed in the body below the at least two socket holes, respectively, wherein the safety shield assembly is disposed between the upper cover and the at least two plug receiving plates, and wherein the at least two openings of the frame correspond in position to the at least two socket holes of the upper cover of the body.

19. The power receptacle of claim 18, wherein the body further includes a second position limiting protrusion, and wherein the sliding block includes a second position limiting face configured to abut the second position limiting protrusion when the sliding block is at the closed position and in a third pivoting state.

* * * * *